US009858908B2

(12) United States Patent
May

(10) Patent No.: US 9,858,908 B2
(45) Date of Patent: Jan. 2, 2018

(54) MARCHING DRUM HARDWARE ARTICULATION DAMPENER

(71) Applicant: Randall Lee May, Newport Beach, CA (US)

(72) Inventor: Randall Lee May, Newport Beach, CA (US)

( * ) Notice: Subject to any disclaimer, the term of this patent is extended or adjusted under 35 U.S.C. 154(b) by 15 days.

(21) Appl. No.: 15/001,477

(22) Filed: Jan. 20, 2016

(65) Prior Publication Data

US 2016/0217775 A1 Jul. 28, 2016

Related U.S. Application Data

(60) Provisional application No. 62/106,315, filed on Jan. 22, 2015.

(51) Int. Cl.
*G10D 13/02* (2006.01)
*G10G 5/00* (2006.01)

(52) U.S. Cl.
CPC ..... *G10G 5/005* (2013.01); *G10D 13/026* (2013.01)

(58) Field of Classification Search
USPC ..... 84/421
See application file for complete search history.

(56) References Cited

U.S. PATENT DOCUMENTS 45,104 A 11/1864 Weston
909,217 A 1/1909 Presba et al.
1,179,063 A 4/1916 Aldrete
1,191,426 A 7/1916 Huddle
1,296,619 A 3/1919 Bulat
2,524,518 A 10/1950 D'Arcy
2,547,818 A 4/1951 Gould
2,717,109 A 9/1955 Walsh
2,990,745 A 7/1961 Casavant
3,227,414 A 1/1966 Dean
4,225,107 A 9/1980 Gleason
4,256,007 A 3/1981 Streit
4,387,839 A 6/1983 Dranchak
4,402,441 A 9/1983 Jines et al.
4,448,105 A 5/1984 Cordes
4,453,442 A 6/1984 LaFlame
4,453,446 A 6/1984 Hoshino
4,605,144 A 8/1986 LaFlame
4,634,032 A 1/1987 LaFlame
4,796,508 A 1/1989 Hoshino
4,799,610 A 1/1989 Hesieh
(Continued)

*Primary Examiner* — Christopher Uhlir
(74) *Attorney, Agent, or Firm* — Crowell & Moring LLP

(57) ABSTRACT

A marching drum articulation dampener for percussion instrument holder that allows attachment to a user mounted carrier. The holder allows adjustment for positioning about the user, and pivoting of the holder to allow the holder to pivot or rotate up to allow the holder with instruments to fit a narrower space. The holder further allows for pivotal attachment of individual drums to link or pivot allowing the linked drums to articulate. The holder can also consist of members that allow a connected drum to move in horizontal position, angle, or height of the drum. A plurality of unique drum connecting members is disclosed that allow the connecting members to connect onto drum tension rods or on a drum lug. A lift assisting mechanism is used to assist in lifts drums from a horizontal to a vertical orientation.

12 Claims, 11 Drawing Sheets

(56) References Cited

U.S. PATENT DOCUMENTS

| | | | | | |
|---|---|---|---|---|---|
| 5,400,683 | A | | 3/1995 | LaFlame | |
| 5,464,137 | A | | 11/1995 | Shirdavani | |
| 5,520,292 | A | | 5/1996 | Lombardi | |
| 5,524,462 | A | | 6/1996 | Loughlin | |
| 5,573,158 | A | * | 11/1996 | Penn | G10G 5/00 224/197 |
| 5,691,492 | A | * | 11/1997 | May | G10G 5/005 84/421 |
| D388,246 | S | | 12/1997 | Patterson | |
| 5,721,389 | A | * | 2/1998 | Kleindienst | G10D 13/026 224/910 |
| 5,806,734 | A | | 9/1998 | Scott | |
| 5,973,247 | A | | 10/1999 | Matthews | |
| 6,028,257 | A | | 2/2000 | May | |
| 6,172,290 | B1 | | 1/2001 | May | |
| 6,403,869 | B2 | * | 6/2002 | May | G10G 5/005 84/421 |
| 6,770,805 | B2 | | 8/2004 | May | |
| 7,326,842 | B2 | | 2/2008 | May | |
| 7,420,110 | B2 | | 9/2008 | May | |
| 7,576,276 | B2 | * | 8/2009 | Hallerberg | G10G 5/005 224/265 |
| 7,673,776 | B2 | | 3/2010 | May | |
| RE42,487 | E | | 6/2011 | May | |
| 8,053,655 | B2 | | 11/2011 | May | |
| 8,505,955 | B2 | * | 8/2013 | Kramer | B60D 1/065 280/504 |
| 8,646,666 | B2 | * | 2/2014 | May | G10G 5/005 224/201 |
| 9,214,142 | B2 | | 12/2015 | May | |
| 2012/0048096 | A1 | | 3/2012 | May | |

* cited by examiner

MARCHING DRUM HARDWARE ARTICULATION DAMPENER

CROSS REFERENCE TO RELATED APPLICATION

This application claims the benefit of Provisional Application Ser. No. 62/106,315 filed Jan. 22, 2015 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to new and useful improvements in apparatus for supporting or carrying percussion instruments, particularly drums of various kinds that arrest the rotational energy when drums are rotated into the playing position.

Description of Related Art Including Information Disclosed Under 37 CFR 1.97 and 1.98

The prior art discloses many examples of apparatus for supporting percussion instruments but none providing the combination of features disclosed and claimed herein.

May U.S. Pat. No. 5,691,492 discloses hardware for supporting drums that is of a hinged construction and has one part of the hinge connectable to an external support, e.g., J-rods on a fixed support or a marching drum carrier, and another part of the hinge connectable to the shell of a drum or to the tension rods on a drum or to other hardware on the drum.

May U.S. Pat. No. 6,028,257 shows a variety of drum hardware and drums secured thereon preferably supported on a vest type carrier or a T-bar carrier or a fixed post or pedestal.

May U.S. Pat. No. 6,172,290 shows a hinged support for an array of drums.

May U.S. patent application Ser. No. 09/756,479, filed Jan. 8, 2001, allowed Jan. 28, 2002, now U.S. Pat. No. 6,403,869 that issued on Jun. 11, 2002 shows a hinged support for one or more drums having means for adjusting the position of a drum to a fixed support or drum carrier. The hinged support may be for an array of drums having means for adjusting the position of the drum array pivotally and inwardly and outwardly relative to fixed drums.

Other possibly relevant prior art is Pyle U.S. Pat. No. 5,054,357, May U.S. Pat. Nos. 5,072,910, 5,300,810, 6,881,886, 6,770,805, RE42,487, 7,166,790, 7,326,842, 7,394,008, 7,420,110, 7,673,776, 7,718,878, 8,053,655 8,598,443, and 9,214,142.

Various prior inventions have been disclosed that attempt to provide percussion positioning and locating apparatus, but none of the listed inventions provide the combination of features and functions proposed by the disclosed carrier.

BRIEF SUMMARY OF THE INVENTION

A percussion instrument holder that allows attachment to a user mounted carrier. The holder allows adjustment for positioning about the user, and pivoting of the holder that allows the holder to slide, pivot or rotate to allow the holder with instruments to fit a narrower space and mitigate the cantilevered load of the drums/instruments being transferred while the player is at rest. The holder further allows for optional pivotal attachment of individual drums to link and pivot to allow the linked drums to articulate. The drums can be fully adjusted in relation to one another, similar to moving links in a chain. The holder can also consist of members that allow a connected drum to move in horizontal position, angle, or height of the drum.

One of the objects of this invention is to provide anew and improved hinged support for an array of drums for support on a pedestal or marching type carrier with means to control the free fall energy when the drums are rotated/lowered to a playing position. The mechanical dampening and/or assist integrated into the hinge allows all the instrument/s to comfortably come to rest connected to the rail to hinge as a group thus eliminating harsh stop forces to the player's back, neck and shoulders.

Another object of the invention is to provide a new and improved hinged support for an array of drums for support on a pedestal or marching type carrier having means for adjusting the position of a drum array relative to fixed drums thereon.

Another object of the invention is to provide a new and improved hinged support for an array of drums for support on a pedestal or marching type carrier having means for adjusting the position of a drum array pivotally and inwardly and outwardly relative to fixed drums thereon. Another object of the invention is to provide a new and improved hinged support for an array of drums for support on a pedestal or marching type carrier having means for adjusting the position of the drums in a drum array relative to each other. The adjustment on the tenor rail or back bar can be narrowed or widened, offset left or right to balance weight. The adjustments can allow the drums to move or slide closer or further away from the body for playing comfort.

Another object of the invention is to provide a new and improved hinged support for an array of drums for support on a pedestal or marching type carrier having novel means for supporting the drums thereon.

Another object of the invention is to provide a new and improved hinged support for drums for support on a pedestal or marching type carrier by J-rod supports or post, channel, tube or track(s) with receiving hardware.

Another object of the invention is to provide a new and improved means for connecting a hinged support for an array of drums for support on individual drums.

Another object of the invention is to provide a new and improved means for connecting a hinged support for an array of drums for support on individual drums, and having hinged sliders for the supporting J-rods of the hardware.

Another object of the invention is to provide new and improved supporting hardware supporting an array of drums, as in a marching drum assembly, having a tubular structure supporting a plurality of drums for pivotal and inward and outward adjustment of the drums.

Another object of the invention is to provide a new and improved hinged support having a back bar or tenor bar or rail for supporting an array of drums for support on a pedestal or marching type carrier in which drums are adjustably supported on rails of a back bar assembly and having J-rod supports adjustable supported thereon.

Another object of the invention is to provide a new and improved hinged support having a back bar assembly for supporting an array of drums for support on a pedestal or marching type carrier in which the back bar assembly is adjustable in length for adjusting the location of drums thereon.

Another object of the invention is to provide a new and improved hinged support for an array of drums for support on a pedestal or marching type carrier having means for pivotally adjusting the position of one drum in the array relative to another.

Another object of the invention is to provide new and improved supporting hardware supporting an array of drums, and having connecting bridges(s) and/or integrated connecting bridge(s) that utilize existing lug casing holes in the drums.

It is still another object of the invention is to provide an extension mechanism or damper that both assists in rotating a secured drum or array of drums from the horizontal playing configuration to a vertical orientation and/or cushions the motion of returning the drum or array of drums to a playing orientation with the aforementioned hinge hardware.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
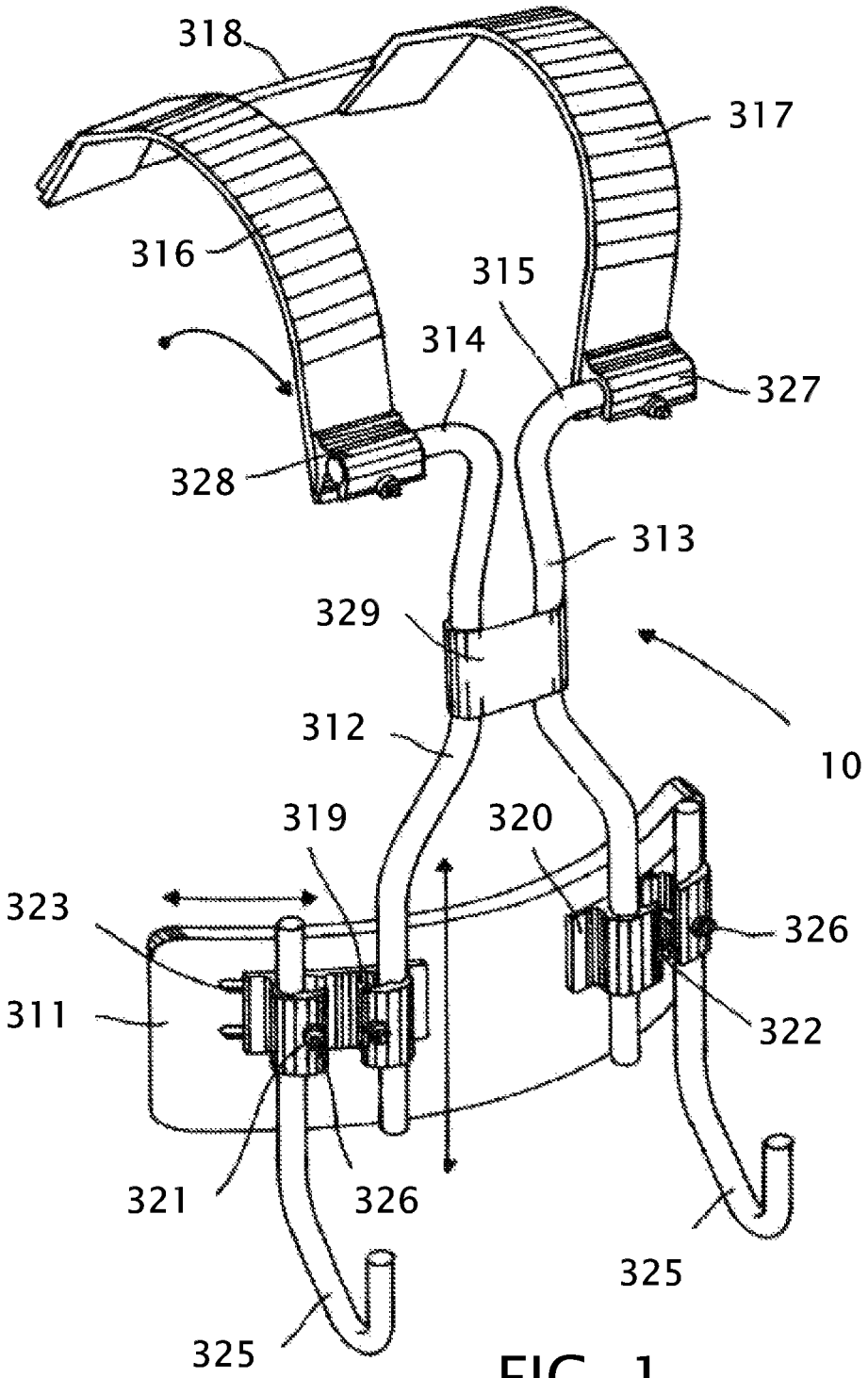
FIG. 1 is a front isometric view of a carrier with J-rod hardware for supporting one or more drum(s) in accordance with one preferred embodiment of the invention.
Figure 2:
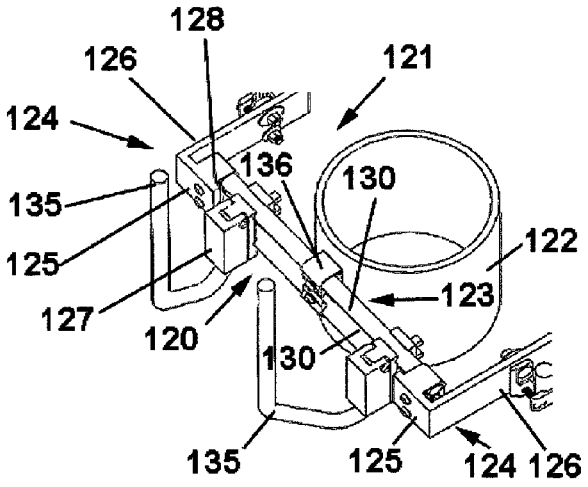
FIG. 2 is an isometric view of an embodiment of supporting hardware supporting an array of drums, as in a marching drum assembly, having hinged sliders for the supporting J-rods of the hardware.
Figure 3:
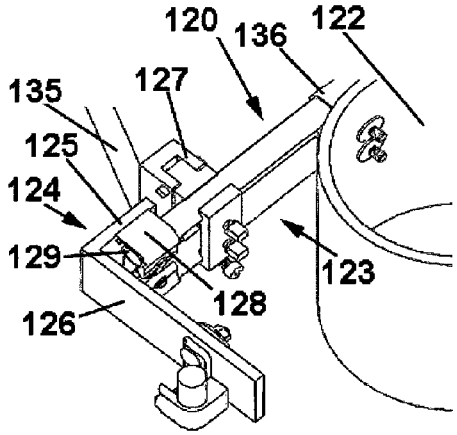
FIG. 3 is a detail isometric view of part of the embodiment shown in FIG. 2.
Figure 4:
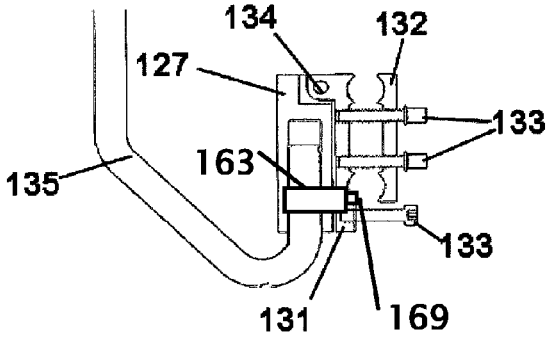
FIG. 4 is a detail view in side elevation of the pivoted hinge in the embodiment shown in FIG. 2.
Figure 5:
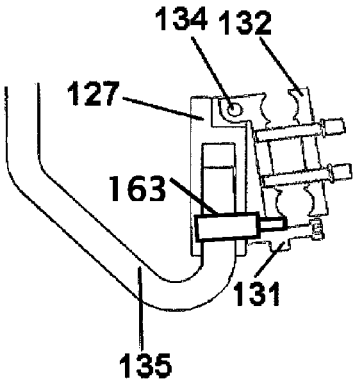
FIG. 5 is a detail view in side elevation of the pivoted hinge in the embodiment shown in FIG. 2 with the hinge in a tilted position.

FIG. 1 is a front isometric view of hardware for supporting a drum in accordance with a preferred embodiment of the invention. In this figure, there is shown a tubular or T-bar-type carrier 10 for percussion instruments which comprises a belly plate 311, vertical supporting rods, tubes or pipes 312 and 313 having outturned portions 314 and 315 supporting rigid shoulder supports 316 and 317 and back bar 318. Back bar 318 may be removably secured to shoulder supports 318 or may be fixed as by welding or the like.

Belly plate 311 is removably secured on the lower ends of vertical rods, tubes or pipes 312 and 313 by clamping receptacles 319 and 320. J-rod receptacles 321 and 322 are secured on belly plate 311 in slots 323 and 324 by screws or bolts or the like. J-rods 325 are secured in receptacles 321 and 322 by bolts 326. The upper, out-turned ends 314 and 315 of supporting rods, tubes or pipes 312 and 313 are supported in clamping receptacles 327 and 328 on shoulder supports 316 and 317. A clamp 329 holds rods, tubes or pipes 312 and 313 against lateral and or torque displacement.

The materials of construction used in this carrier 10 are very important for achieving the desired result. The belly plate 311, vertical supporting rods, tubes or pipes 312 and 313, shoulder supports 316 and 317 and back bar 318 are rigid and made of a light material such as plastic or a light metal such as aluminum, magnesium or titanium. The metal shoulder supports have the advantage that different sizes are readily accommodated.

Operation

The operation of this carrier should be apparent but will be described briefly for clarity. The carrier 10 is worn by the musician with the shoulder supports 316 and 317 positioned over the shoulders and the belly plate 311 supported against the abdomen. J-rods 325 are inserted in position and secured in place by tightening bolts 326. The short outer ends of the J-rods 325 are inserted into the J-rod receptacles on the percussion instrument being carried, e.g., drums (single or array), cymbals, xylophone, marimba, or the like.

The carrier is adjustable to comfort of the wearer and also to fit different sized instruments. Clamp-receptacles 327 and 328 permit pivotal, lateral and angular adjustment of shoulder supports 316 and 317 on the out-turned ends 314 and 315 of rods, tubes or pipes 312 and 313. Clamp-receptacles 319 and 320 permit vertical sliding adjustment of rods, tubes or pipes 312 and 313. Slots 323 and 324 in belly plate 311 allow lateral adjustment of clamp-receptacles 321 and 322 and angular adjustment of J-rods supported therein.

Refer now to FIGS. 2-5 that shows a hinge assembly 120 for supporting a multiple drum assembly or array 121 as used in marching bands. Hinge assembly 120 is similar in function to those shown in FIGS. 23-17 of May U.S. Pat. No. 6,028,257 with additional features permitting adjustability that is not possible in the embodiment of the patent.

Multiple drum assembly or array 121 (FIGS. 2, 3) comprises at least one drum 122 secured for support and carrying by a drummer as in a marching band. Drum array 121 includes drum 122 supported on the fixed part of a hinge assembly. In this embodiment, hinge assembly 120 provides a hinged support between the drum array 121 and a suitable marching carrier.

Hinge assembly 120 (FIGS. 2, 3) comprises a back bar assembly that is the fixed member of the hinge. Back bar assembly 123 has two end pieces 124 each of which comprises a one-piece casting having a flat portion 125 with a bent portion 126 bent at a right angle thereto.

Flat portion 125 has J-rod receptacles 127 formed integral therewith, in which J-rods are supported. A socket member 128 is secured on each flat portion 125. Socket member 128 has two cylindrical rods 130 that fit on opposite ends into receptacles 129. Clamp member 136 supports drum 122 on rods 130. J-rod receptacles 127 are clamped on rods 130 by a split clamp having a base portion 131 (FIGS. 4 and 5) and clamping portion 132 secured thereon by bolts 133. Base portion 131 is hinged to receptacle 127 at 134. The upper two bolts 133 extend through base portion 131 and clamping portion 132 and, when tightened, clamp the receptacle 127 on rods 130. The lowermost bolt 133 extends through base member 131 to engage receptacle member 127 and, when tightened, tilts the clamping members 131, 132 as in FIGS. 4 and 5. A dampener 163 is positioned to absorb the rotation of the drum 122 or drum array as it rotates into the playing position. A magnet 169 can be used to withdraw the piston of the damper when the drum or drum array is being rotated.

Operation

Hinge assembly 120 is supported by positioning J-rod receptacles 127 over J-rods 135 on a marching carrier or on a fixed drum support. Drum 122 is supported on rods 130 and is movable thereon. Drum 122 is supported on rods 90 for sidewise adjustment, and permits adjustment of the spacing if more than one drum 82 is positioned thereon. Rods 130 can be tilted in relation to J-rod receptacles 127 by operation of the lowermost bolt 133 as described above.

Figure 7:
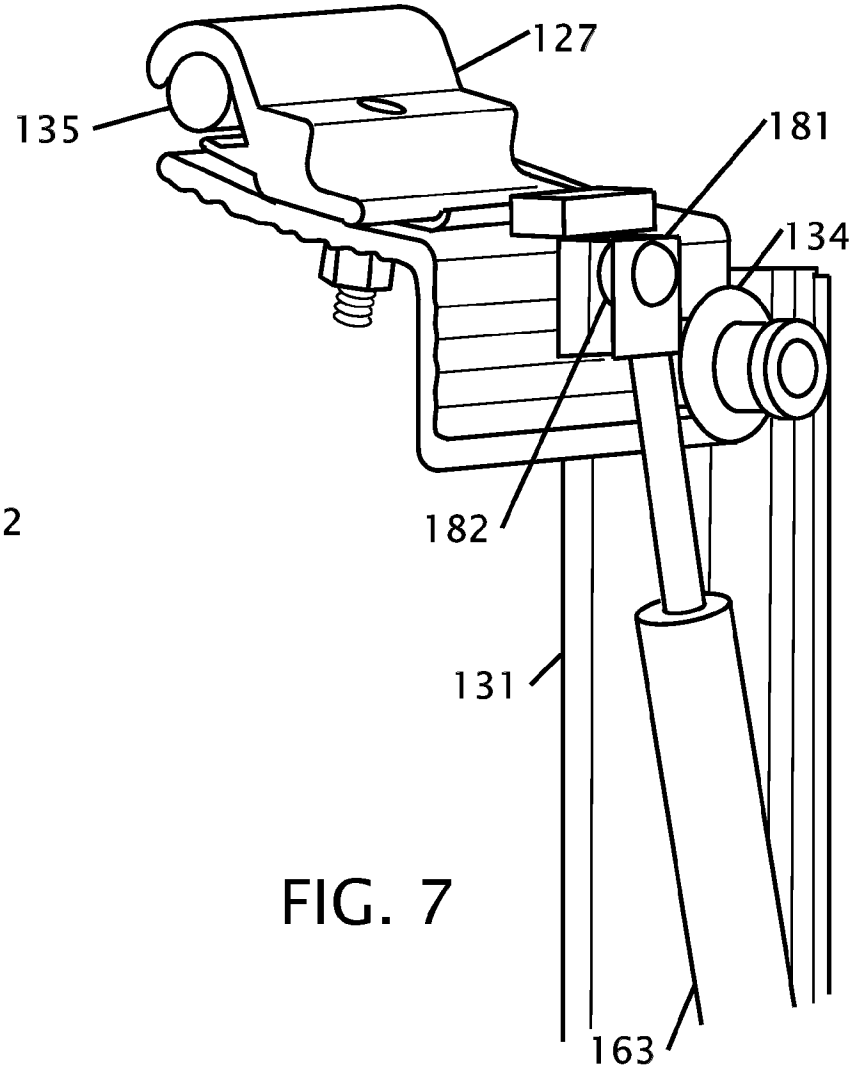
FIG. 7 shows a perspective cross-sectional view of drum to carrier mounting hardware embodiment shown in FIG. 6 in a raised orientation.
Figure 6:
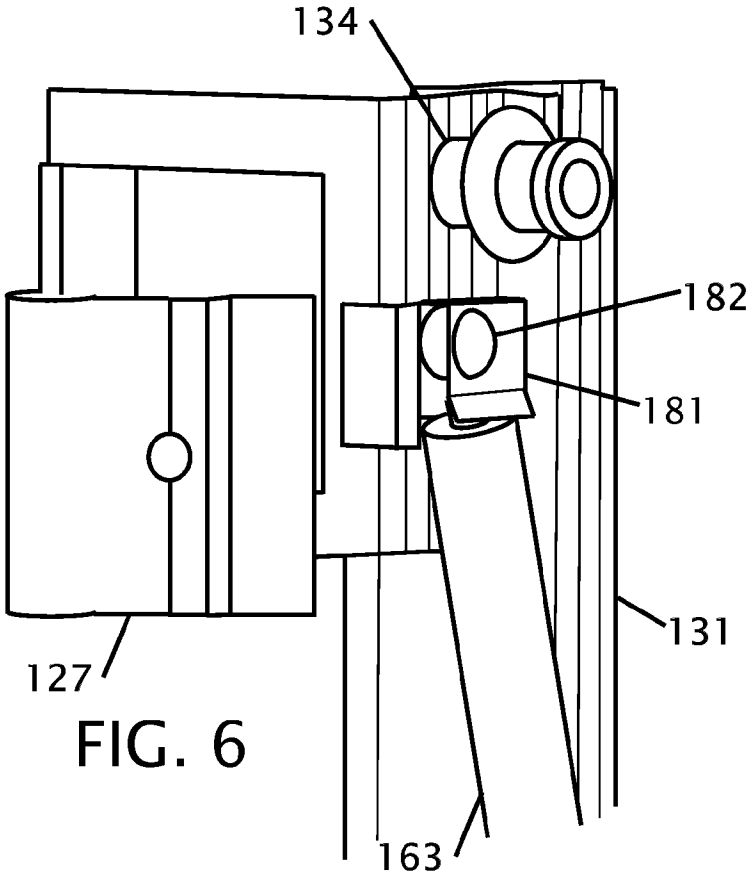
FIG. 6 shows a perspective cross-sectional view of drum to carrier mounting hardware in a lowered orientation.

FIG. 6 shows a perspective cross-sectional view of carrier to drum mounting hardware in a lowered orientation and FIG. 7 shows a perspective cross-sectional view of carrier to drum mounting hardware in a raised orientation.

In these figures the drum's mounting rod 135 is secured in receiver 127. The drum or drum array is secured to the rail or support 131. The rail or support 131 rotates through pivoting axis 134. Piston extension or damper 163 cushions travel of the drum or drum array as the drum or drum array moves to the playing position. The end of the piston extension or damper 163 has a ball 182 that is secured in a socket receiver 181. The socket receiver 181 is a flexible spring type material that allows the ball 182 to be withdrawn and inserted into the receiver 181. The ability to remove the piston extension or damper 163 engagement from the receiver allows a performer to take the drum or drum array off of an instrument carrier. The drum or drum array can then be re-installed on the instrument carrier and the ball 182 can then be re-engaged into the socket 181.

Figure 8:
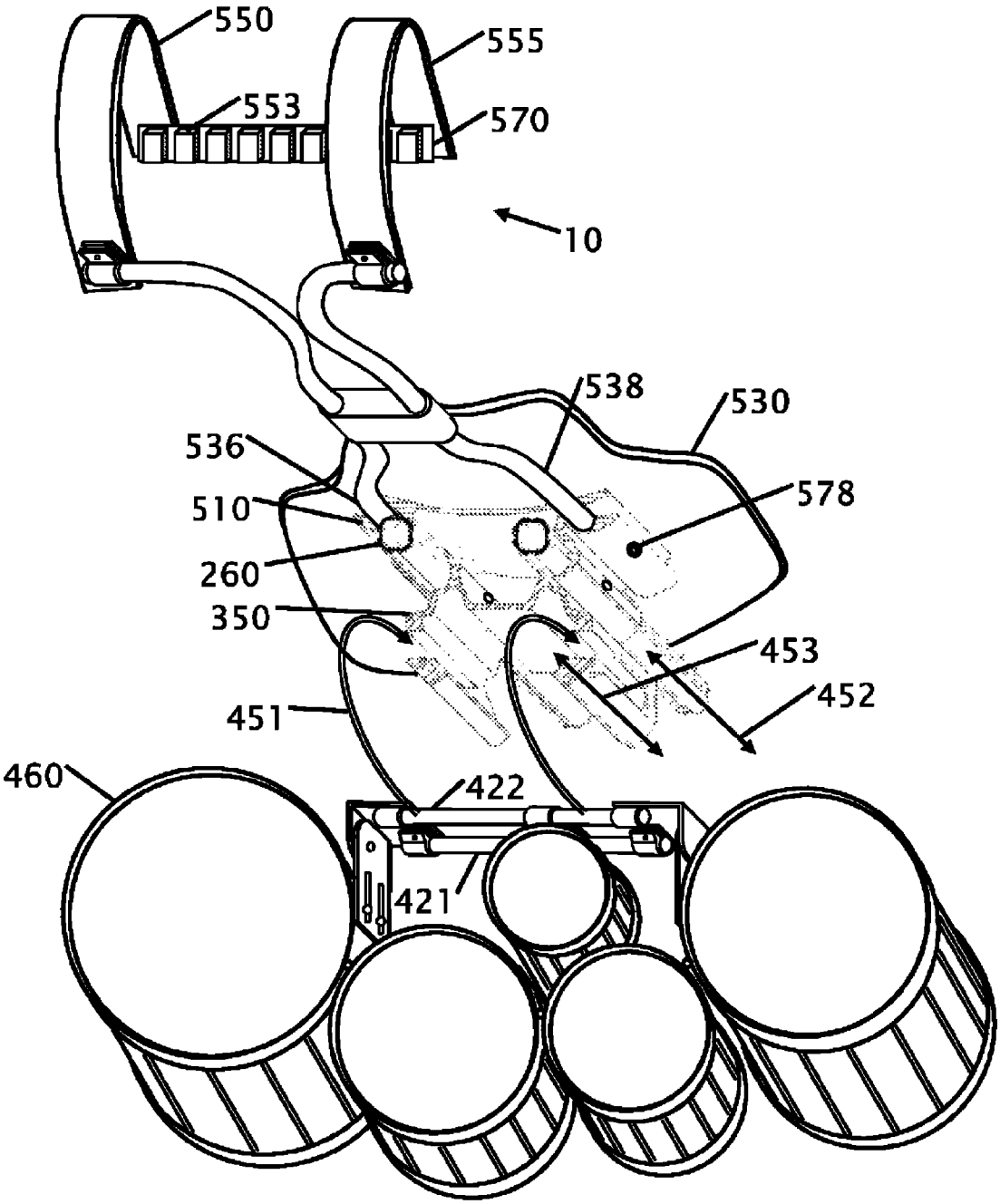
FIG. 8 is a second preferred embodiment showing the dual posts system secured to an instrument carrier with a drum assembly that is mountable on the dual post system.

FIG. 8 shows another preferred embodiment with a parallel quad track incorporating two post system secured to an instrument carrier with a drum assembly that is mountable on the parallel quad track system receiver. The shoulder supports and or back member may optionally include padding 553. The tubular carrier shown includes an abdomen plate 530 that is secured or can float on the structure without being rigidly secured to first bifurcated structure 510. In the embodiment shown the first bifurcated structure 510 is shown and described as a single structure but it is contemplated that the structure could be fabricated in two halves where each half is secured to the abdomen plate to form the structure. Tubes 536 and 538 of the carrier bend and extend into first bifurcated structure 510 where they are positioned and lockable in position using tightening hardware 578. The tubes 260 slide in first bifurcated structure 510 and in second bifurcated structure 350 to allow for positioning of the drum array and drum hardware 460. In the embodiment shown the second bifurcated structure 350 is shown and described as a single structure but it is contemplated that the structure could be fabricated in two halves where each half is secured to the tubes or shafts 260. The tubes, posts or shafts 260 can be movable 452, as well as the second bifurcated structure 350 can be fabricated to be movable 453 independently.

In operation the upper tube 422, from the drum array, is lowered 451 into the essentially vertical slot until the bottom tube 421 from the drum array rests on the bottom radius or saddle (353 from FIG. 39). The cantilevered weight of the drum array will rotate the drum array until the upper tube 422 of the drum supporting array sits in the top radius (354 from FIG. 9). It is contemplated that the shafts, posts or tubes 260 can be fabricated as an integral part of either first bifurcated structure 510 or the second bifurcated structure 350 to allow for only one adjustment.

Figure 9:
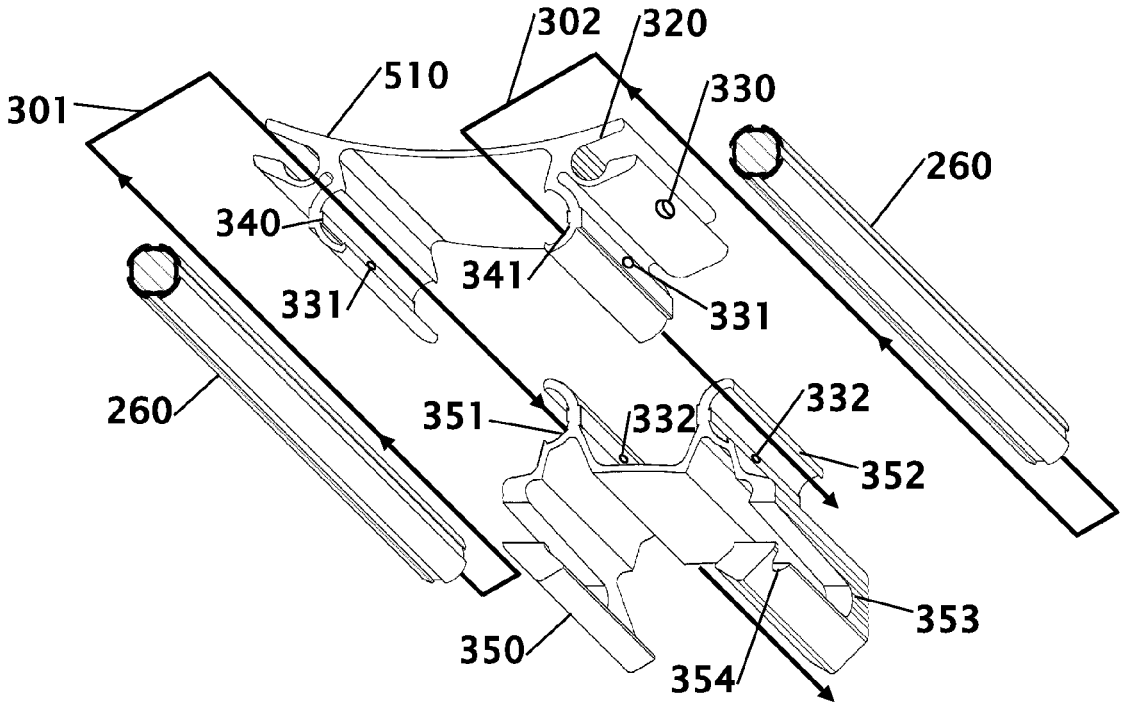
FIG. 9 shows the components of a second preferred embodiment of a dual post system that is mounted to an instrument carrier from FIG. 8.

FIG. 9 shows the components of a dual post quad track system that is mounted to an instrument carrier. For a better understanding of the components and how they relate, FIG. 9 should be viewed in combination with FIG. 8. In FIG. 9 the first bifurcated structure 510 is shown. This first bifurcated structure 510 has a rounded back that matches the contour of the abdomen plate that the structure in mounted on. On the front of the first bifurcated structure 510 linear dual tracks 340 and linear dual tracks 341 and the tubes 260 are securable with sets screw 331. The parallel linear quad tracks provide a first quad track structure. The tracks are located essentially parallel to the abdomen plate and at a location that is distal from the abdomen plate in a vertical orientation. It is contemplated that the abdomen plate 530 can float on the structure without being rigidly secured to first bifurcated structure 510. The first bifurcated structure 510 further includes mounting clamps 320 for securing tubular shafts for connection with the shoulder supporting portion of a carrier. The connection with the tubular portion of the shoulder supported portion of the carrier. A locking mechanism is threaded or fastened into the carrier at 330 to pinch or thread into the tube(s) 536 or 538 (FIG. 8).

In FIG. 9 tubes 260 are slid 301 and 302 into the linear quad tracks 340 and 341 respectively. The linear tracks 340 and 341 have male dovetail recesses that engage in female dovetail recesses in tubes or rods 260. The tubes or shafts 260 are locked in location on the linear tracks of the first bifurcated structure 510 with a securing means such as a set screw. The second bifurcated structure 350 engages on the tubes 260 between the first bifurcated structure 510 to allow independent movement of the second bifurcated structure 350. The second bifurcated structure 350 has similar recess 351, 352 and dovetail engagement with the tubes or shafts 260 as in the first bifurcated structure 350. The second bifurcated structure 350 is secured to the tubes or rods 260 with securing means such as a set screw 332. In the front of the second bifurcated structure a pair of essentially vertically oriented slots exists for loading at least one drum or an array of drums. The vertical slots have a bottom radius or saddle 353 and a top radius 354 for locating the drum or drum array in the essentially vertically oriented slots. A further description of the vertical slots for securing one or more drums is shown and described in more detail with FIG. 8.

Figure 10:
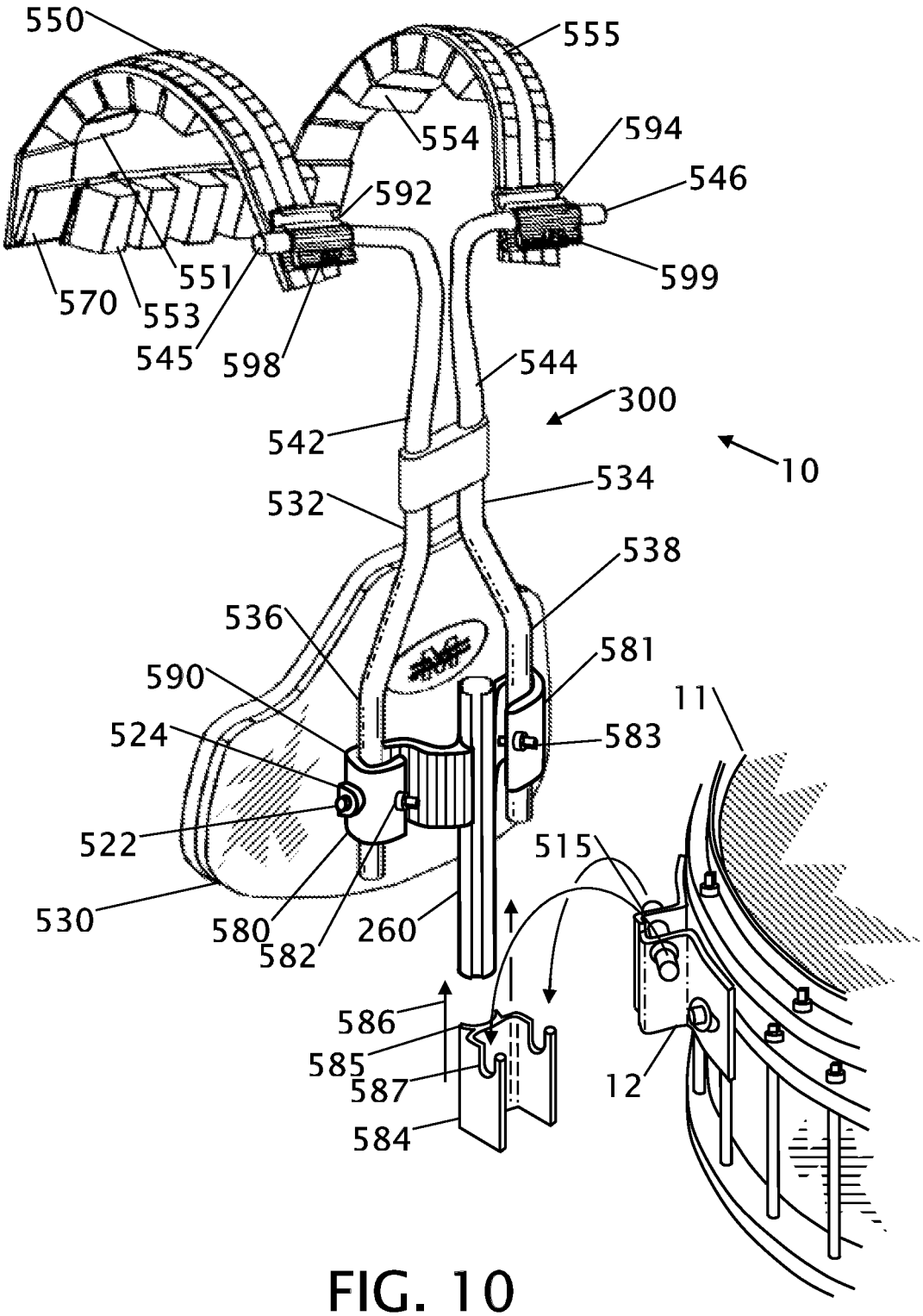
FIG. 10 is a third preferred embodiment showing a dual track single post system that is mounted to an instrument carrier for use with a single drum.

FIG. 10 shows a view of the drum tracking system for use with a single drum 11. The carrier 10 comprises an abdomen plate 530, with lower support rods 532 and 534. The figure also has upper body vertical support rods or tubes 542 and 544. The upper and lower body support rods or tubes are connected to each other with a retainer 300 that keeps the tubes in a parallel relationship. The lower rods or tubes 532 and 534 independently spread to parallel portions 536 and 538 where they attach to supporting abdomen plate 30. Upper rods or tubes 542 and 544 having out-turned portions 545 and 546 supporting rigid shoulder straps 550 and 555 and back bar 570. Back bar 570 may be removably secured to shoulder straps 550 and 555 or may be fixed as by welding or the like. Shoulder straps 550, 555, and back bar 570 have cushions 551, 553 and 554, respectively. The cushions are of a type used to pad the interior of football and other sports helmets and enclose separate blocks which are separately compressible and provide more comfort to the wearer of the carrier when fully loaded.

The abdomen plate 530 is secured to the bridge supports 590 with a pivot 522 that extends through ears 524 on the abdomen plate 530. The placement of the pivot through the center of the bridge support 590 allows the abdomen plate to rotate a limited amount on the pivot(s) 522. The pivoting allows the abdomen plate to move with the user without significantly altering the position of the carrier on the user. The pivots can be tightened slightly to provide frictional or limited pivoting as well as loosened to allow for free pivoting. It is also contemplated that the abdomen plate 530 is removably secured on carrier.

Clamping receptacle(s) 580 and 581 consist of a semi-circular receptacle that tubes 536 and 538 fit through. Tightening hardware 582 and 583 clamps the tube or rod to secure them within the receptacle and prevent movement. The clamping receptacle(s) 580 and 581 are secured on abdomen plate 530. The receptacles are shown mounted to the abdomen plate 530, and the tubes can be re-positioned within the receptacle, but the receptacles can be mounted to slots that allow the locations of the receptacles to be moved. The upper, out-turned ends 545 and 546 of supporting rods or tubes are supported in clamping receptacles 592 and 594 on shoulder straps 550 and 555. Clamps 592 and 594 hold rods or tubes 545 and 546 on the shoulder supports. Clamping mechanisms 592 and 594 consist of a semi-circular receptacle that tubes 545 and 546 fit through. Tightening hardware 598 and 599 clamps the tube or rod to secure them within the receptacle and prevent movement. A single tube or shaft 260 is used to connect with a single drum 11 through a sliding cradle 584.

The sliding cradle 584 connects to the single tube or shaft 260 with dovetail grooves. A second set of dovetail grooves exist on the bridge support member 590. The bridge support member 590 has male dovetail grooves that mate with the female dovetail groves in the tube or shaft 260. A similar set of male dovetail features 585 exist on the sliding cradle 584. These dovetail features are arranged to allow the sliding cradle to slide 86 past the bridge support member 590. The sliding cradle 584 has a recessed cradle 587 for connection with the hinge pins 515 of a single drum 11. The hinge pin 515 is secured to the drum 11 with a rotation hinge plate. The rotation hinge plate 12 and its connection to the drum is shown and described in more detail in my prior patent (May U.S. Pat. No. 5,691,492).

Figure 11:
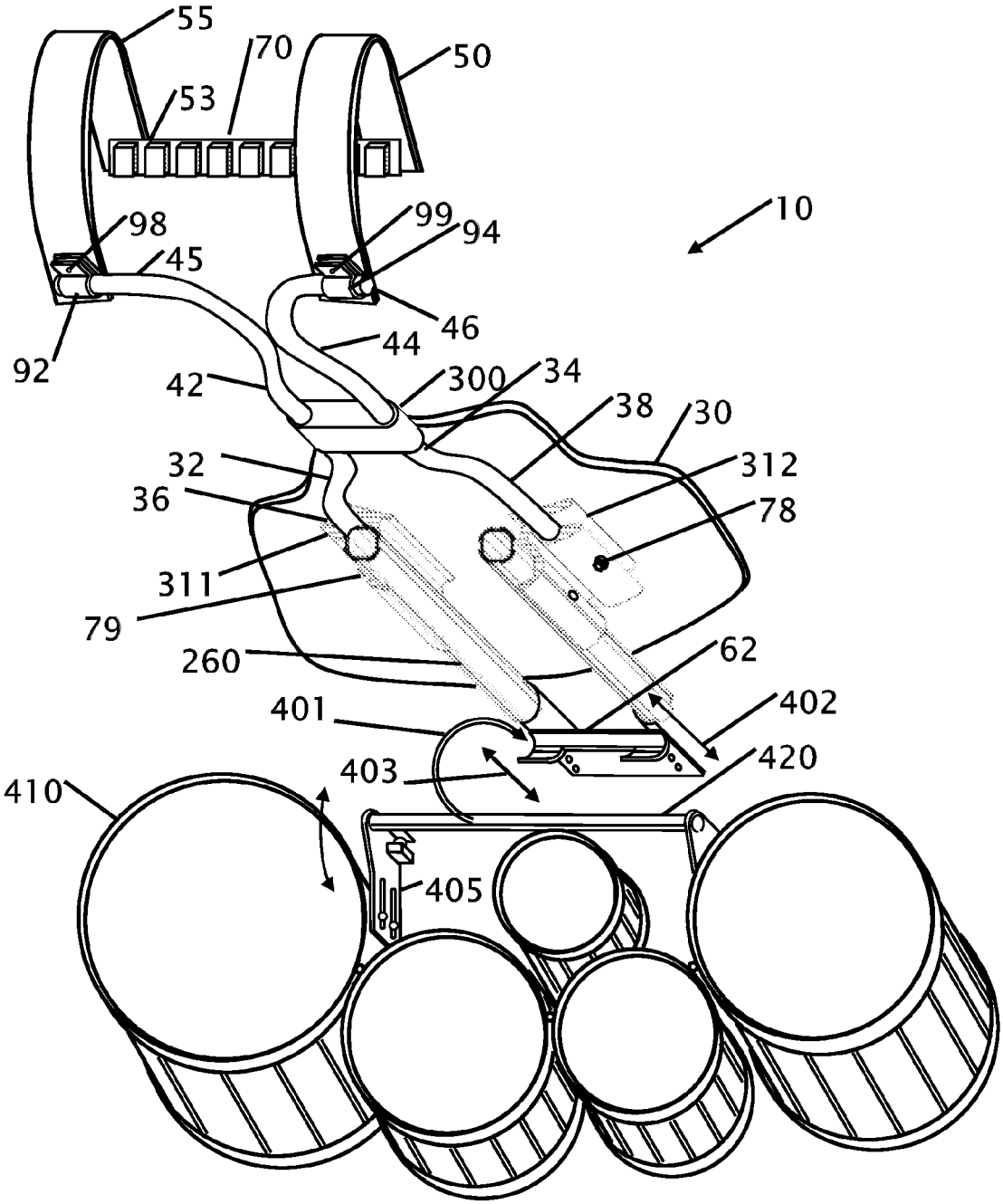
FIG. 11 shows an instrument carrier according to another preferred embodiment.

FIG. 11 shows an instrument carrier according to another preferred embodiment. This figure shows a Tubular type carrier 10 for percussion instruments that comprises an abdomen plate 30, with lower support tubes or rods 32 and 34. The figure also has upper body vertical support rods or tubes 42 and 44 that are supported mid-span with a retainer 300. In the figure shown the coupler is a fixed member that holds the tubes in rigid position, but it is also contemplated that the coupler could be a hinge or an adjustable coupler that allows the distance between the upper and lower portions of the carrier to be adjusted as well as a single or compound hinged coupler that allows the carrier to be folded as shown in May U.S. Pat. No. 7,166,790 and May U.S. Pat. No. 6,323,407.

The lower rods or tubes 32 and 34 are bent where they independently spread to parallel portions 36 and 38 where they attach to supporting abdomen plate 30. Upper rods or tubes 42 and 44 having out-turned portions 45 and 46 supporting rigid shoulder straps 50 and 55 and back bar 70. Back bar 70 may be removably secured to shoulder straps 50 and 55 or may be fixed as by welding or the like. Shoulder straps 50, 55, and back bar 70 have cushions 53. The cushions are of a type used to pad, the interior of football and other sports helmets and are shown in more detail in co-issued May U.S. Pat. No. 6,028,257. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded. The abdomen plate 30 is removably secured on the lower ends of tubes or rods 32 and 34 by the left and right halves of the first bifurcated structure 311 and 312 respectively where each half uses semi-circular clamping receptacle that tubes 36 and 38 fit through. In the embodiment shown the first bifurcated structure is shown and described in two halves it is contemplated that these two halves can be fabricated as a single (attached) unit. Tightening hardware 78 and 79 (not visible) clamps the tube or rod to secure them within the left and right halves of the first bifurcated structure 311 and 312 prevent movement. The two halves of the first bifurcated structure 311 and 312 are secured on abdomen plate 30. The clamping receptacles are shown mounted to the abdomen plate 30, and the tubes can be re-positioned within the clamping receptacle, but the clamping receptacles (part of first bifurcated structure 311 and 312) can be mounted into slots or without fasteners that penetrate the abdomen plate, such as hook and loop, that allow the locations of the clamping receptacles to be free floating on the abdomen plate. The upper, out-turned ends 45 and 46 of supporting rods or tubes are supported in clamping receptacles 92 and 94 on shoulder straps 50 and 55. Clamps 92 and 94 hold rods or tubes 45 and 46 on the shoulder supports. Clamping mechanisms 92 and 94 consist of a semi-circular receptacle that tubes 45 and 46 fit through. The bolts 98 and 99 are tightening to clamp the tube or rod to secure them within the receptacle and prevent movement as shown in May U.S. Pat. No. 7,071,401.

The materials of construction used in this carrier 10 are very important for achieving the desired result. The abdomen plate 30 is preferably made from a flexible material to aid in contouring to the player's profile and size. The supporting rods or tubes 32, 34, 42, and 44, shoulder straps 50, 55 and back bar 70 are rigid and made of a light metal such as aluminum, magnesium or titanium. The metal shoulder straps have the advantage that different sizes of users are readily accommodated by adjusting or replacing the shoulder straps in a vertical or horizontal plane.

Operation

The operation of this carrier should be apparent but will be described briefly for clarity. The carrier 10 is worn by a musician with the shoulder straps 50 and 55 positioned over the shoulders. The position of the shoulder straps and the upper portion of the carrier can be adjusted by loosening bolts 78 and 79 for vertical adjustment of the shoulders. When the bolts 98 and 99 are loosened, clamps 92 and 94 open to allow tubes 42 and 44 to slide within the clamps. When the clamps are loose, the position of the clamps on the shoulder straps can also be adjusted. The vertical adjustment of the shoulder straps allows users of different sizes to use the carrier. The width between the shoulder straps can also be adjusted by rotating the tubes 42 and 44 within retainer 300. When tubes 42 and 44 are rotated the width of the shoulder straps are moved in and out. The rotational adjustment allows the tubes to be toe-in so the width and or the position of the tubes can be adjusted. The toe-in adjustment is mostly used with tubular construction, but a similar adjustment could be made with other types of carrier construction. The abdomen plate 30 is attached to the left and right halves of the first bifurcated structure 311 and 312 and then to rods 36 and 38 that are inserted in position and secured in place by tightening bolts 78 and 79. The parallel ends of the rods 36 and 38 are inserted into the receptacles on the abdomen plate. When bolts 78 and 79 are loosened, receptacles move on tubes 36 and 38 can be moved to allow positioning of the abdomen plate on the carrier. This adjustment allows the carrier to accommodate user of various sizes. The left and right bifurcated structure 311 and 312 have an additional attachment mechanism for the percussion instrument being carried e.g., drums (single or array), cymbals, xylophone, marimba, or the like that will be further described herein.

The tubular carrier shown includes an abdomen plate 30 that is secured or can float on the structure without being rigidly secured to the halves of the first bifurcated structure 311 and 312. The support rods or tubes 34 and 36 of the carrier bend and extend into their respective halves of the first bifurcated structure 311 and 312 where they are positionable and lockable in position. The tubes 260 slide in their respective halves of the first bifurcated structure 311 and 312 to allow for positioning 402 of the drum array 410 and drum hardware 420 independently from the positioning of the distance between the shoulder supports 50, 55 and the abdomen plate 30. In operation the drum array tube 420 from the drum array is lowered 401 into the essentially horizontal saddle 403 until the tube 420 from the drum array rests on the bottom radius of the half tube saddle portion 62. The cantilevered weight of the drum array will rotate the drum array binding the dovetail rib 66 (FIG. 2) of the half tube portion 62 with one end portion 65 to fit one of the dove tailed grooves 41 and a dove tailed rib 66 fitting into an adjacent groove. The drum array tube 420 can side horizontally along the half tube portion 62 where the drum array is justified left or right of the player.

Drum array tube 420 is lowered 401 into the half tube saddle portion 62 where it is retained. The retention is shown and described in more detail with FIGS. 2-4. The slide bracket 63 connects with a set of parallel tracks that mate with the tubes or shafts 260 to allow the half tube saddle portion 62 to secure the drum array, and can be raised or lowered 402 on the tubes or shafts 260. Drum array side member(s) 405 connect the tube 420 to the drum array 410. The drum array tube 420 can side horizontally in the half tube portion 62 such that the drum array is justified drum array tube 420 is marked to identify the balance position or other indicia to identify a particular location. Another contemplated feature is to include one or more stops on the drum array tube 420 to limit side (slide) movement of the drum array in the half tube saddle portion 62.

Figure 12:
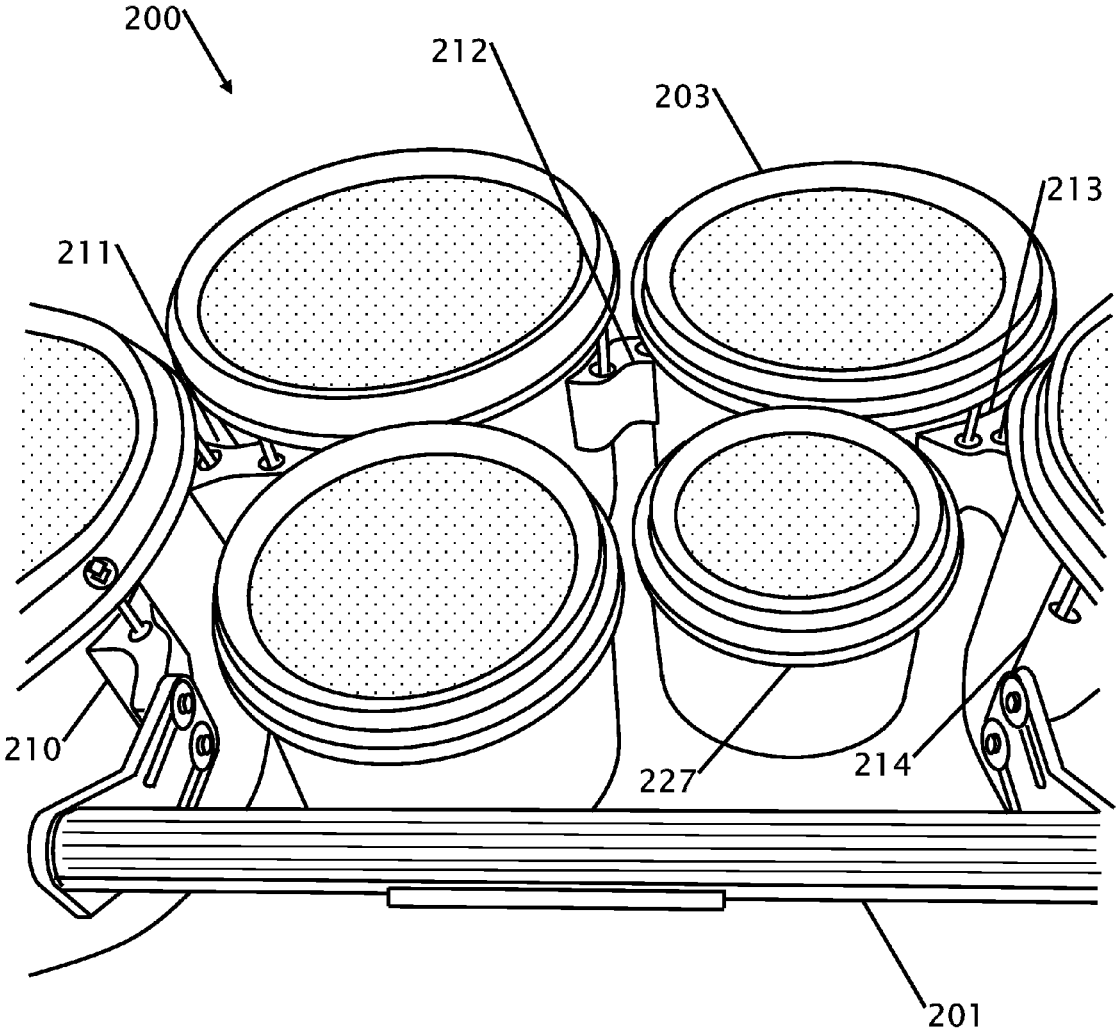
FIG. 12 shows an array of drums connected with the lug bridge.

FIG. 12 shows an array of drums 200 connected with a plurality of lug bridges. The drum array 200 is shown with a plurality of drums 203 mounted on a tenor back bar or rail 201. A plurality of lug bridge attachment hardware 211, 212 and 213 connects the drums together. Lug bridge connectors 210 and 214 connects from the drum array to the tenor back bar or drum supporting hardware 201.

Figure 13:
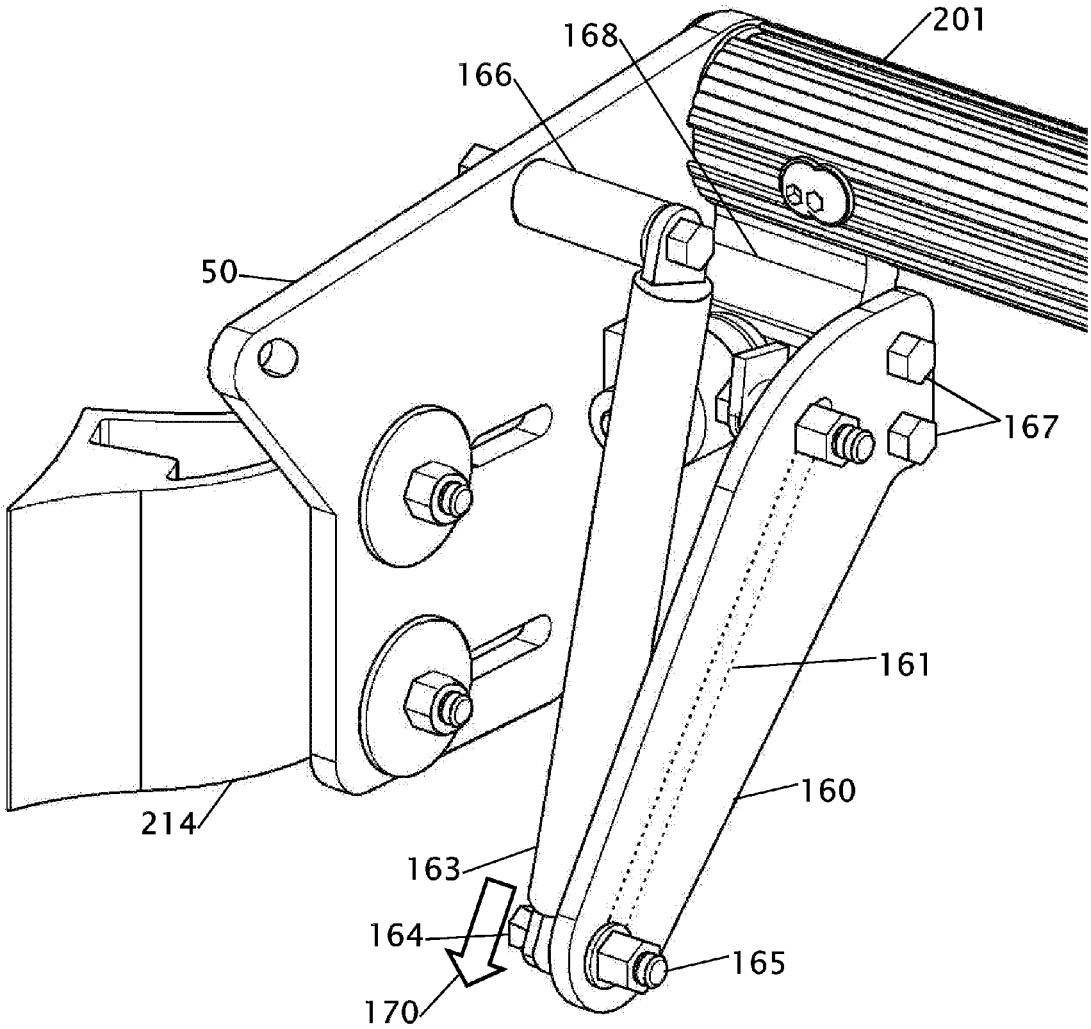
FIG. 13 shows a perspective view of the articulating and/or pivoting drum hardware in the deployed orientation.

FIG. 13 shows a perspective view of the articulating drum hardware in the deployed orientation. The drums are not shown in this figure to provide greater visibility of the components in the deployed orientation. The deployed orientation is where the drums are in a playing mode where the playing surfaces of the drums are essentially horizontal. In this figure an extension mechanism or damper 163 is incorporated into the drum supporting hardware. The extension mechanism in this figure is a gas filled strut, but the extension mechanism or damper 163 could be a spring, a damper or other similar device. The extension mechanism or damper 163 is secured to a plate or arm 160 with an optional slot 161 that allows the mounting nut 165, bolt 164 and/or fastener to be positioned and secured to the plate 160. The plate 160 is secured with hardware 167 on spacer or plate 168 to the hinge plate 50 that pivots on the tenor back bar 201.

The opposing end to the extension mechanism or damper 163 is secured with a spacer 166 that aligns the extension mechanism or damper 163 with the plate 160 and the hinge plate 50. One lug bridge connector 214 is visible and secured to the hinge plate 50. When the extension mechanism expands 170 it assists in lifting the drum array that is secured to the hinge plate 50. When the drum array is lowered the extension mechanism or damper compresses and also provides some cushion to the end of the stroke of the extension mechanism or damper 163. When the extension mechanism or damper 163 is completely extended the playing surfaces of the drums is essentially vertical.

Figure 14:
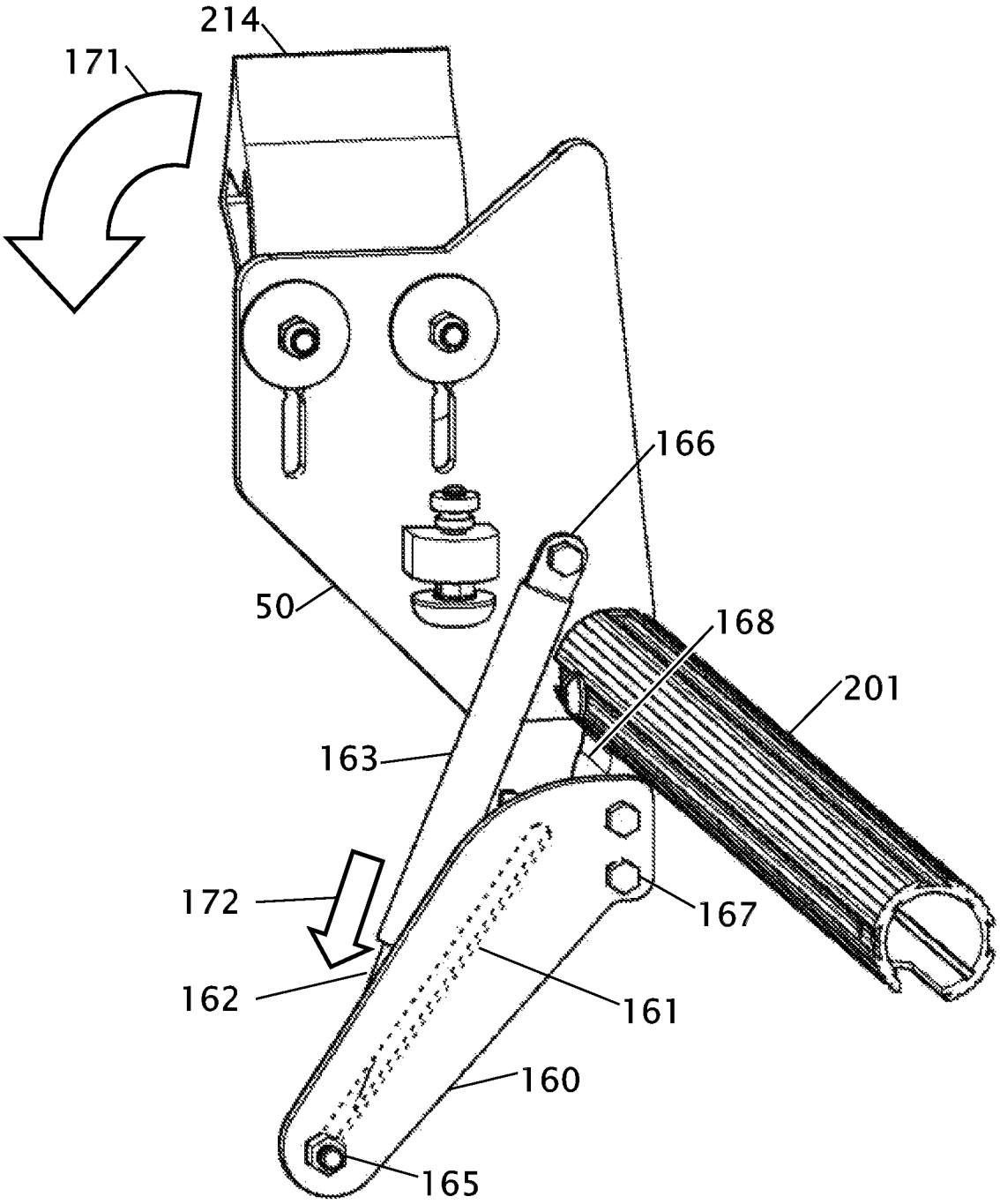
FIG. 14 shows a perspective view of the articulating and/or pivoting drum hardware in the lifted orientation.

FIG. 14 shows a perspective view of the articulating drum hardware in the lifted orientation. In this figure the extension mechanism or damper 163 has the rod 162 extended. With the rod extended the hinge plate 50 is rotated on the tenor back bar or rail 201. One lug bridge connector 214 is visible and secured to the hinge plate 50. When the extension mechanism or damper expands 170 it assists in lifting the drum array that is secured to the hinge plate 50. When the drum array is lowered the extension mechanism or damper compresses and also provides cushion to the end of the stroke of the extension mechanism or damper 163. The drums are not shown in this figure to provide greater visibility of the components in the deployed orientation.

Figure 15:
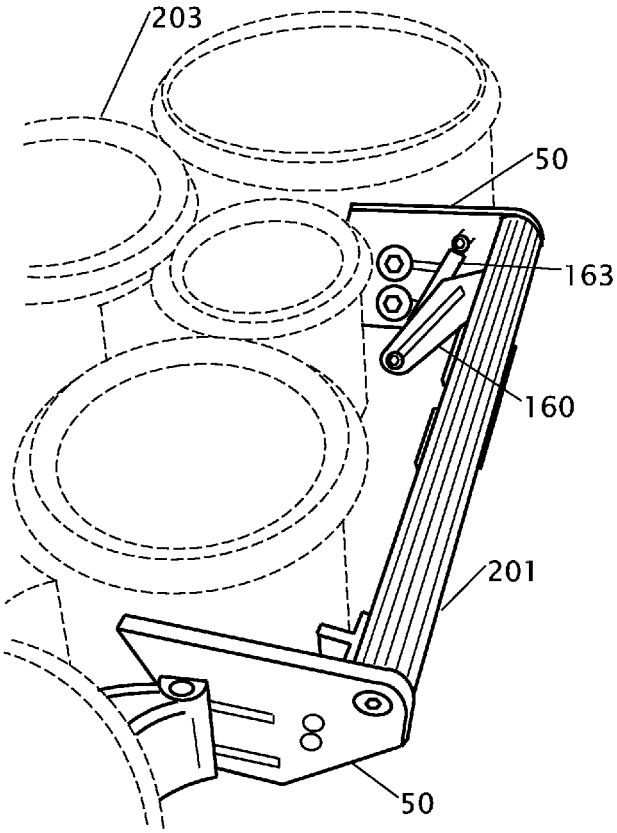
FIG. 15 shows a perspective view of the articulating and/or pivoting drum hardware with drums in the deployed orientation.
Figure 16:
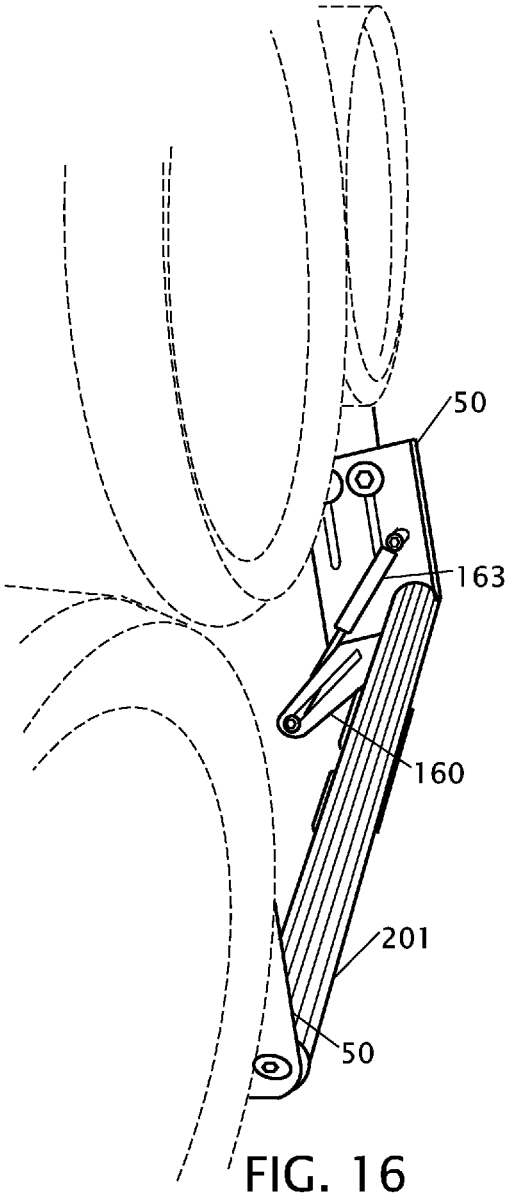
FIG. 16 shows a perspective view of the articulating and/or pivoting drum hardware with drums in the lifted orientation.

FIG. 15 shows a perspective view of the articulating drum hardware with drums in the deployed orientation and FIG. 16 shows a perspective view of the articulating drum hardware with drums in the lifted orientation. The drum array is shown in these figures as broken lines for easier visibility between the assisting hardware and the drum array. The extension mechanism or damper pushes between the plate 160 and the hinge plate 50 to assist in lifting the drum array and also to cushion the end of the stroke when the drum or the drum array is being lowered. While only one side is shown with an extension mechanism or damper, the same arrangement can be incorporated into the mirror side of the tenor back bar 201.

While an array of drums is shown in these figures, it should be understood by one skilled in the art that the lift assisting mechanism can be configured to operate with as few as one drum.

Thus, specific embodiments and applications for a carrier assembly for percussion instruments have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. Marching drum hardware, comprising:

a mounting member configured to be supported on a marching carrier;

a drum-securing member configured to support at least one drum thereon, the drum-securing member pivotally coupled to the mounting member via a respective hinge joint so as to rotate with respect to the mounting member between a non-cantilevered rest position wherein the at least one drum is vertically orientated, and a cantilevered playing position wherein the at least one drum is horizontally oriented; and a mechanical motion damper configured to control an otherwise forward rotational free-falling motion of the drum-securing member from the non-cantilevered rest position to the cantilevered playing position via progressively dampening the forward rotational free-falling motion while maintaining contact with drum-securing member through the controlled motion, and further configured to not resist a backwards rising motion.

2. The marching drum hardware according to claim 1, wherein the damper comprises a gas filled strut or spring.

3. The marching drum hardware according to claim 1, further including an arm extending from the damper to couple to the mounting member.

4. The marching drum hardware according to claim 3, wherein said arm further includes a elongate slot.

5. The marching drum hardware according to claim 4, wherein damper is configured to slide within the slot.

6. The marching drum hardware according to claim 5, wherein sliding the damper within the slot provides a mechanical advantage to a lifting or lowering motion of the at least one drum between the cantilevered playing position to the non-cantilevered rest position.

7. The marching drum hardware according to claim 1, wherein the mounting member is configured to be removeably supported on the marching carrier.

8. The marching drum hardware according to claim 1, wherein the damper removeably engages one of: the mounting member and the drum-securing member, and fixedly engages the other one of: mounting member and the drum-securing member.

9. The marching drum hardware according to claim 8, wherein the removable engagement is via a magnetic coupling.

10. The marching drum hardware according to claim 8, wherein the damper comprises a ball.

11. The marching drum hardware according to claim 10, wherein the damper is configured such that the ball removeably engages a socket receiver of the mounting member.

12. The marching drum hardware according to claim 10, wherein said ball is magnetically coupled to the mounting member.

* * * * *